United States Patent [19]

Vanderpool et al.

[11] 4,409,019

[45] Oct. 11, 1983

[54] METHOD FOR PRODUCING COBALT METAL POWDER

[75] Inventors: Clarence D. Vanderpool; Martin B. MacInnis, both of Towanda, Pa.

[73] Assignee: GTE Products Corporation, Stamford, Conn.

[21] Appl. No.: 448,579

[22] Filed: Dec. 10, 1982

[51] Int. Cl.[3] ..... C22B 23/04

[52] U.S. Cl. ..... 75/0.5 AA; 75/108; 75/119

[58] Field of Search ..... 75/0.5 AA, 119, 108

[56] References Cited

U.S. PATENT DOCUMENTS

| | | | |
|---|---|---|---|
| 4,184,868 | 1/1980 | Ritsko et al. | 75/0.5 AA |
| 4,218,240 | 8/1980 | Gingerich et al. | 75/0.5 AA |
| 4,233,063 | 11/1980 | Ritsko et al. | 75/0.5 AA |

*Primary Examiner*—W. Stallard

*Attorney, Agent, or Firm*—Robert E. Walter

[57] ABSTRACT

A fine cobalt metal powder is produced from pieces of relatively pure cobalt by dissolving the cobalt pieces in an aqueous solution of hydrogen iodide and iodine and forming a cobalt containing solid which is subsequently reduced to a fine cobalt metal powder.

7 Claims, No Drawings

METHOD FOR PRODUCING COBALT METAL POWDER

The present invention relates to the preparation of cobalt metal powder from relatively pure sources of cobalt. Fine cobalt powder of high purity is typically used in the manufacture of cemented carbide cutting tools, magnetic tapes and magnetic inks.

BACKGROUND OF INVENTION

U.S. Pat. No. 3,810,967 to Takasu discloses a process for recovering cobalt from an oxo reaction product wherein cobalt is converted to a water soluble iron salt of carbonized cobalt.

U.S. Pat. Nos. 4,214,896; 4,218,240; 4,184,868; 4,329,169 and 4,233,063 relate to the preparation of cobalt metal powder from ammonia and chloride containing cobalt solutions.

SUMMARY OF INVENTION

The cobalt industry produces a high purity cobalt which is available as electrolytic cobalt produced by electroplating. The electrolytic cobalt is typically produced as plates approximately one-eighth to one quarter of an inch thick which are broken off cathodes after electroplating. These pieces are a source of pure cobalt but are in varying sizes and shapes and are, hence, unsuited for use in the carbide industry which requires powder.

Grinding the cobalt cathode pieces to fine powder is not practicable due to the difficulty of obtaining properly sized powder with a low impurity level. High purity cobalt dissolves slowly in common mineral acids except nitric acid. The use of nitric acid represents a source of air pollution with nitrogen oxides.

In accordance with the present invention, cobalt metal powder is produced from a source consisting essentially of cobalt by contacting the cobalt source with an aqueous solution of hydrogen iodide and iodine. The iodine is present in the aqueous solution in an amount sufficient to solubilize a portion of the cobalt source and from a solution containing cobalt values. The cobalt values are reduced to produce a fine cobalt metal powder.

DETAILED DESCRIPTION

The cobalt source used in the process of the present invention is a relatively pure source. A typical source is cobalt produced by electrolytic processes. The source preferably has an impurity level of less than about one percent by weight and more preferably less than 0.5 percent by weight.

The cobalt source is contacted with an aqueous solution of hydrogen iodide and iodine. The iodine is preferably present at a concentration and in an amount sufficient to solubilize a major portion of the cobalt. Preferably about 1 to about 10 parts of iodine are present per 100 parts of water. Since iodine is insoluble in water, hydrogen iodide is present in an amount sufficient to provide for solubility of the iodine at the desired amount. Preferably hydrogen iodide is present in an amount from about 1 to about 40 parts of hydrogen iodide per 100 parts of water. Preferably the aqueous solution consists essentially of hydrogen iodide, iodine and water and the cobalt source consists essentially of cobalt. Both the cobalt and the solution may include other additives or impurities provided such ingredients do not interfere with the solubilization process or subsequent recovery of cobalt from a solution. Generally the solution should comprise from about two moles of iodine per mole of cobalt.

The contacting step may be carried out conveniently in a batch type process where the cobalt source is immersed in he aqueous iodine containing solution. Preferably the solution is heated to a temperature of from about 50 to about 75 degrees centigrade for a period of about 15 minutes. Time and temperature do not appear to be critical except that higher temperatures tend to reduce the length of reaction time. The process may be carried out with successive decreasing additions of aqueous hydrogen iodide and iodine solution. The amount of iodine needed may be initially estimated and a solution prepared. As the reaction proceeds, the characteristic iodine color disappears. If unsolubilized cobalt is present, a further addition of solution may be made. Preferably the additions may be made in decreasing amounts until substantially all the cobalt is solubilized in a resulting solution.

The resulting solution comprising solubilized cobalt is separated from the solution by evaporating the liquid. The iodine may be collected by condensation from the vapor stage for reuse. Cobalt is deposited from the solution as a cobalt containing precipitate.

The precipitate has a black coloration and is believed to be $CoI_2.H_2O$. The black solid is crystalline and turns green on standing in air. Preferably the black crystals are dried prior to reduction to produce a green powder. Air drying may be performed at a temperature of about 95° to about 100° C.

Extra fine particle size cobalt, preferably having a Fisher Sub Size of less than about 2.0 and more preferably less than about 1.5 is produced by the reduction of the green powder. Larger size cobalt powder, of a size less than about 3.0 containing particles greater than about 2.0 may be produced by reducing the black solid prior to air drying.

EXAMPLE 1

About 20 grams of broken cathodes were added to a 50—50 mixture of hydriodic acid and water under reflux to retain the acid. Then a small amount of elemental iodine was added. The color at first turned reddish brown and then clear, as the iodine combined with the cobalt. Elemental iodine was added slowly until the color of the iodine remained, approximately 80 grams. In approximately 3 hours, all the broken cathodes had dissolved. The solution was then evaporated to dryness on the steam bath (approximately 95°-100° C.) overnight. This produced a black crystalline solid which on standing in air turned green. It is speculated that the compound is $CoI_2.2H_2O$ EXAMPLE 2

About 100 grams of broken cathodes were placed in reaction vessel with 100 grams of HI and 100 cc of $H_2O$. The while heating with reflux to retain the acid, elemental iodine was added in 50-gram portions. After 400 grams of iodine had been added (approximately 5 hours), the reaction was stopped and the undissolved cobalt removed. 89.9% of the cobalt cathodes had dissolved. The resulting solution was evaporated on the steam bath 95°-100° C. overnight to a heavy black syrup. On cooling, the liquid crystallized into black crystals.

During reduction of these black crystals, the material puffed into a black porous mass which then reduced into a fine cobalt powder with FSSS particle sizes between 1.9 and 2.9. This was too large for an extra fine grade of cobalt. However by drying these black crystals at 95°–100° C., a greenish powder was produced. This was reduced at 400° C. for 2.5 hours at 20 grams per boatload to give a FSSS particle size of 1.4 microns.

We claim:

1. A method of producing cobalt metal powder from a source consisting essentially of cobalt comprising contacting said cobalt source with an aqueous solution of hydrogen iodide and iodine, said iodine being present at a desired concentration and in an amount sufficient to solubilize a portion of said cobalt source and form a solution containing cobalt values, reducing said cobalt values to produce a cobalt metal powder.

2. A method according to claim 1 wherein said aqueous solution of hydrogen iodide and iodine comprises from about 1 to about 40 parts of hydrogen iodide per 100 parts of water and from about 1 to about 10 parts of iodine per 100 parts of water.

3. A method according to claim 1 wherein said aqueous solution consist essentially of hydrogen iodide, iodine and water.

4. A method according to claim 3 wherein said aqueous solution comprises in excess of about two moles of iodine per mole of cobalt.

5. A process according to claim 3 wherein said aqueous solution is heated to a temperature of about 40 to about 70 degrees centigrade during contacting.

6. A process according to claim 3 wherein said aqueous solution containing cobalt values is treated to precipitate a cobalt containing compound.

7. A process according to claim 6 wherein said cobalt containing compound is reduced to cobalt metal powders by heating in a reducing atmosphere for a sufficient period of time and at a sufficient temperature to form a cobalt metal powder.

* * * * *